US005734968A

United States Patent [19]

Lay

[11] Patent Number: 5,734,968

[45] Date of Patent: Mar. 31, 1998

[54] SAFE RADIO CONTROL SYSTEM

[76] Inventor: Dean Lay, P.O. Box 541585, Orlando, Fla. 32854

[21] Appl. No.: 621,807

[22] Filed: Mar. 22, 1996

[51] Int. Cl.[6] ..... H04B 1/10; H04B 15/00

[52] U.S. Cl. ..... 455/63; 455/132; 455/140; 340/825.75

[58] Field of Search ..... 455/4.1, 38.2, 455/95, 101, 103, 104, 227, 228, 229, 151.1, 151.2, 352, 132, 140; 340/825.69, 825.72, 825.73, 825.74, 825.75; 380/10, 20; 446/475, 176, 211

[56] References Cited

U.S. PATENT DOCUMENTS 5,149,290 9/1992 Reveen ..... 446/475

5,579,391 11/1996 Ihara ..... 380/15

5,620,355 4/1997 Watkins ..... 446/475

*Primary Examiner*—Edward F. Urban

*Assistant Examiner*—Darnell P. Armstrong

*Attorney, Agent, or Firm*—Ronald B. Sherer

[57] ABSTRACT

A remote control system for actuating special effects theatrical devices is disclosed in which a transmitter generates and transmits two different signals, and a receiver includes first and second receiver circuits such that the first signal arms the receiver but does not actuate the special effects theatrical device unless and until said second signal is also received.

20 Claims, 1 Drawing Sheet

SAFE RADIO CONTROL SYSTEM

FIELD OF THE INVENTION

The present invention relates to a remote control system, and more particularly to a remote radio control system which cannot be accidentally triggered by a spurious radio signal.

BACKGROUND

As radio controlled systems, such as for garage door openers and the like, as well as other radio transmitters such as walkie-talkies, become more popular and more prevalent, a serious danger has arisen in that the assigned frequencies of such devices have become so crowded that a radio signal from one transmitter may interfere with the operation of a radio controlled device intended to be operated by an entirely different transmitter. By way of example, a serious problem has arisen in the attempted use of radio control of special effects in the entertainment industry such as, for example, turning special effects lights on and off and/or actuating confetti launching cannons; such lights and cannons being ceiling-mounted or mounted in other locations of difficult access. In these situations, the systems usually must be set up a number of hours before the performance, and they must remain ready to operate at the critical time during the performance. However, such systems are subject to the ever present danger that they may be set off prematurely by a passing police car, or a security guard operating a walkie-talkie, or any other spurious radio signal with a frequency sufficiently close to the frequency of the radio receiver in the theatrical system. Such premature actuations have become unacceptably frequent in recent years, and they usually ruin the theatrical performance, as well as create a disappointed and unhappy audience.

SUMMARY

The present invention solves this serious problem by creating a remote radio control transmitter capable of generating and transmitting two entirely different radio signals, and creating a radio receiver receptive to both of such different signals in a manner whereby the first signal arms or activates the circuit so as to be receptive to the second signal to actuate the theatrical device.

The foregoing and other objects of the present invention will become more fully apparent from the following description of several preferred embodiments taken with the following drawings.

DETAILED DESCRIPTION

Figure 1A:
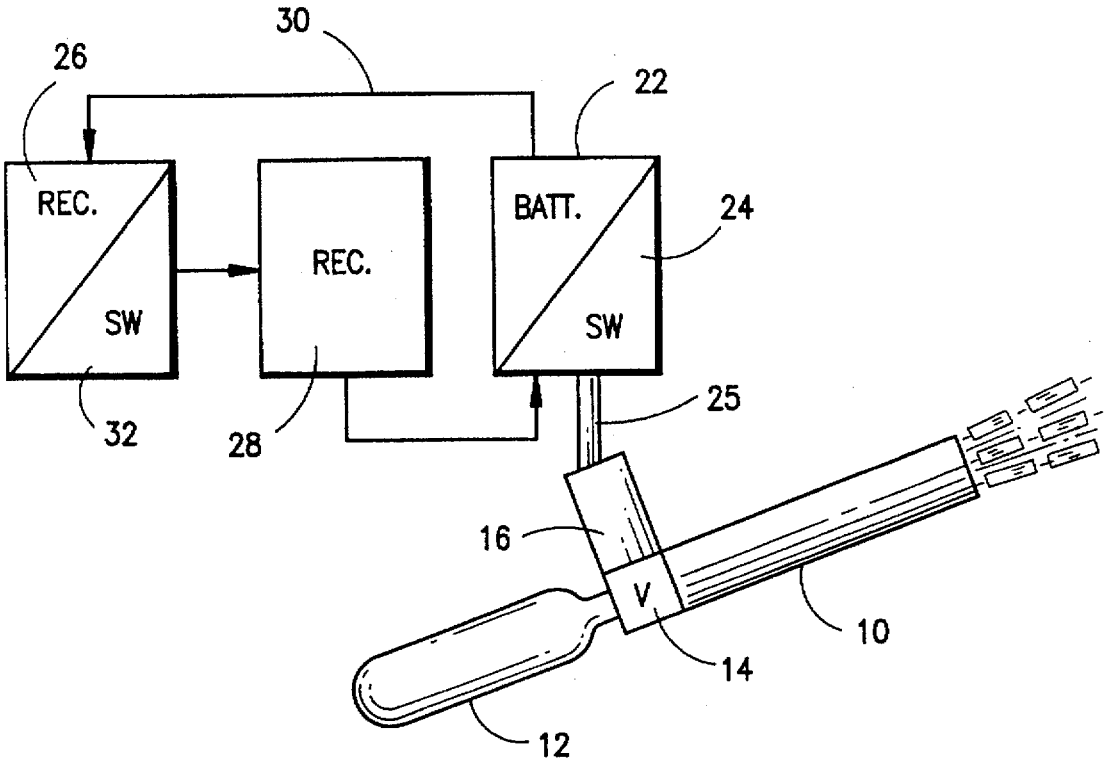
FIGS. 1A and 1B are schematic illustrations of a confetti launching cannon actuated by the receiver and transmitter of the present invention.
Figure 1B:
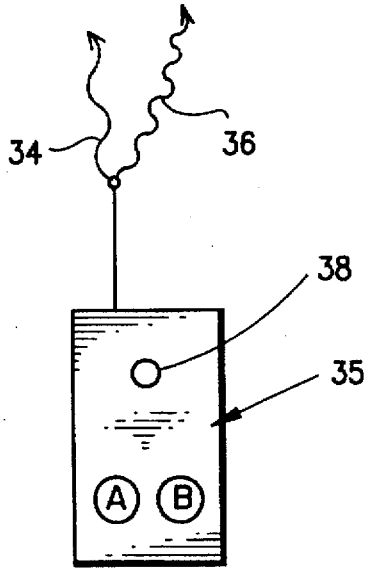

Referring to FIG. 1, numeral 10 indicates a confetti launching cannon. Such cannons are generally known and comprise a length of tubing, such as PVC tubing, which is filled with confetti, and preferably with FLUTTER FETTI® confetti as described in U.S. Pat. Nos. 5,352,148 and 5,419,731. Compressed air or $CO_2$ is contained in a high pressure cylinder 12, and the flow of the compressed gas is controlled by an on-off valve 14 operated by a solenoid 16. Thus, when solenoid 16 is actuated by a flow of current, valve 14 is opened and the high pressure gas from cylinder 12 launches the confetti out of the cannon in a large visual display of color and motion.

Such confetti launching systems are frequently located in high and difficult-access places such as, for example, in ceiling rafters, on ceiling-mounted light banks, and on the tops of buildings at amusement parks. As such, it has long been desired to have such systems self-powered and remote controlled. That is, to be operable without running either electric power lines or control circuit wires to such remote locations, and the present invention fulfills this need.

As further shown in FIG. 1, one embodiment of the overall receiver circuitry 20 includes a battery 22 which is connected through a switch, or switching circuit, 24 to supply power to solenoid 16 through leads 25. By way of example, it has been found that a battery of either the alkaline or NiCad type having a voltage in the order of 3 to 12 volts, and preferably 6 volts performs very well in operating solenoid 16 and opening valve 14. Within these preferred voltage ranges, the same battery 22 may also be employed to supply preferred voltages and currents to operate first and second receiver circuits 26 and 28, respectively. As illustrated schematically, battery 22 supplies a voltage to receiver circuit 26 through schematic connection 30, and when activated by a first signal 34 from transmitter 35, as will be further described hereinafter, receiver circuit 26 supplies a voltage through switch, or switching circuit, 32 to receiver circuit 28. However, this voltage to receiver circuit 28 only activates circuit 28 to be "on," or "receptive" to a second, different signal to be received by receiver circuit 28 from transmitter 35. Thus, only when the first signal 34 is received by the first receiver circuit 26 does the second receiver circuit 28 become turned "on" or "receptive." Then, only when second receiver circuit 28 receives the second signal 36, of different frequency and/or wave shape than the first, does second receiver circuit 28 activate switch, or switching circuit, 24 to pass current from battery 22 to solenoid 16 to launch the confetti. In this manner, the receiver circuitry 20 prevents any spurious signal from launching confetti prematurely because, even if such spurious signal matches one or other of predetermined signals 34 or 36, the control system will not supply power to the solenoid. Rather, the solenoid can only be actuated when: (a) receiver circuit 26 is receiving a signal corresponding to signal 34 and, (b) at the same time, receiver circuit 28 is receiving a signal corresponding to signal 36. Thus, both of switches A and B of the transmitter must be turned on in order for the two signals to be generated simultaneously and transmitted to the respective receiver circuits 26 and 28.

As a further safety precaution, it is preferred that transmitter 35 include an on-off power switch 38 so that no signal may be inadvertently transmitted by accidental bumping or pushing of push button or toggle switches A and/or B.

With respect to the first and second signals 34 and 36, the two signals may be signals of substantially different frequencies. Alternatively, the first signal may be a pulsed signal, or of a unique wave shape, or may be a carrier signal with a second signal imposed thereon so as to be as different as possible from other signals used for radio communication and controlling remotely actuated devices. However, even if the two signals only differ as to their frequencies, the chances of two spurious signals existing at the same time, with the two spurious signals matching the two different frequencies of the predetermined signals, is extremely remote.

As previously mentioned, the remote radio control system of the present invention may be utilized to operate other types of special effects such as turning on lights and/or actuating pyrotechnic displays.

Figure 2:
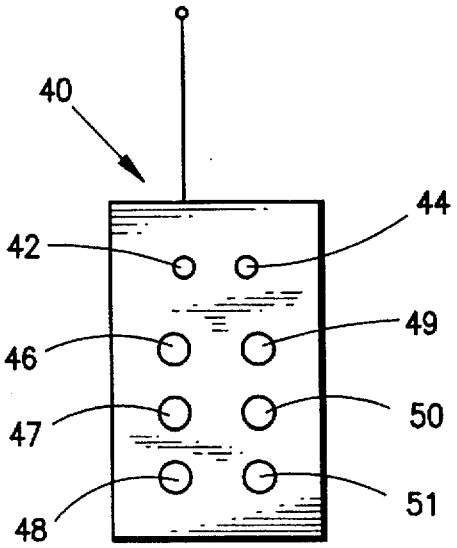
FIG. 2 is a schematic illustration of a remote control transmitter comprising a further embodiment of the present invention.

A further preferred feature of the present invention is illustrated in FIG. 2 wherein a transmitter 40 for actuating multiple special effects devices is shown. In this embodiment, the transmitter has a power on-off switch 42 corresponding to switch 38, and also has an "ARM" switch 44 corresponding to switch A of the FIG. 1B embodiment. However, instead of a single switch B, the transmitter of the FIG. 2 embodiment has a plurality of switches 46 through 51. Each of the switches 46–51 activates a different tuning circuit whereby closure of each switch transmits a signal of a different frequency, and it will be understood that receiver circuitry 20 includes a plurality of second receiver circuits 28 with each such receiver circuit tuned to receive one of the secondary signals of different frequencies produced by closure of switches 46 to 51. In this manner, the transmitter of the FIG. 2 embodiment includes the same safety features of the previous embodiment in that two separate and different signals must be generated and transmitted simultaneously in order for switching circuit 24 to be turned on. At the same time, one transmitter and one multiple receiver circuit may actuate a plurality of different special effects devices such as, for example, multiple confetti cannons, multiple lights, and/or multiple pyrotechnic displays, and combinations of these and other special effects.

In the foregoing description, the control circuit has been described as being powered by a battery, and this source of power is preferred whenever the installation is to be used only once, or only a few times, or wherever AC power is not readily available. However, if the installation is to be relatively permanent, or where AC power outlets may be available, such as in wired ceilings of many ballrooms, convention centers and theaters, then it will be apparent that AC power may be substituted for battery 22 if desired.

From the foregoing description of several preferred embodiments of the present invention, it will be apparent that numerous variations will be apparent to those skilled in the art of radio transmitting and receiving. Accordingly, it is to be understood that the foregoing description is intended to be illustrative of the principals of the invention, rather than limiting thereof, and that the present invention is not to be limited other than as expressly set forth in the following claims interpreted under the doctrine of equivalents.

What is claimed is:

1. A remote radio control system for actuating special effects devices comprising:

(a) a special effects device mounted in a first location;

(b) first and second radio receiver circuits mounted adjacent said special effects device, said first and second receiver circuits being tuned to receive first and second radio signals, respectively;

(c) said first receiver circuit being connected to said second receiver circuit so as to activate said second receiver circuit only when said first signal is received by said first receiver circuit;

(d) a radio transmitter, said transmitter including means for generating and transmitting said first and second radio signals to said first and second receiver circuits; and (e) circuit means connected between said second receiver circuit and said special effects device for actuating said device when said first and second signals are simultaneously received by said first and second receiver circuits, respectively.

2. The remote radio control system of claim 1 wherein said special effects device comprises a cannon containing confetti and compressed gas source means for launching said confetti from said cannon.

3. The remote radio control system of claim 1 wherein said special effects device comprises means for producing a pyrotechnic display.

4. The remote radio control system of claim 1 wherein said special effects device comprises special effects lights.

5. The remote radio control system of claim 1 wherein said first and second radio receiver circuits are powered by a battery positioned adjacent said receiver circuits.

6. The remote radio control system of claim 1 wherein said transmitter is a hand-held battery operated transmitter.

7. The remote radio control system of claim 1 wherein said means for generating and transmitting said first and second radio signals generates and transmits said first signal with a first frequency and said second signal with a different frequency from said first frequency.

8. The remote radio control system of claim 1 wherein said means for generating and transmitting said first and second radio signals generates and transmits said first signal of a first waveform and said second signal of a different waveform from said first waveform.

9. The remote radio control system of claim 1 wherein said second receiver circuit includes a plurality of second receiver circuits, and means for tuning each of said plurality of second receiver circuits to different frequencies for actuating a multiplicity of special effects devices only after said first receiver circuit activates said plurality of second receiver circuits.

10. A remote radio control system for actuating theatrical special effects devices comprising:

(a) a special visual effects device mounted in a remote location;

first and second radio receiver circuits mounted adjacent said special effects device, said first and second receiver circuits being tuned to receive first and second radio signals, respectively;

(c) battery means connected to power said first and second radio receiver circuits;

(d) said first receiver circuit being connected to said second receiver circuit so as to activate said second receiver circuit only when said first signal is received by said first receiver circuit;

(e) a radio transmitter, said transmitter including means for generating and transmitting said first and second radio signals to said first and second receiver circuits; and (f) circuit means connected between said second receiver circuit and said theatrical special effects device for actuating said device when said first and second signals are simultaneously received by said first and second receiver circuits, respectively.

11. The remote radio control system of claim 10 wherein said special effects device comprises a cannon containing confetti and compressed gas source means for launching said confetti from said cannon.

12. The remote radio control system of claim 10 wherein said special effects device comprises means for producing a pyrotechnic display.

13. The remote radio control system of claim 10 wherein said special effects device comprises special effects lights.

14. The remote radio control system of claim 10 wherein said transmitter is a hand-held battery operated transmitter.

15. The remote radio control system of claim 10 wherein said means for generating and transmitting said first and second radio signals generates and transmits said first signal with a first frequency and said second signal with a different frequency from said first frequency.

16. The remote radio control system of claim 10 wherein said means for generating and transmitting said first and second radio signals generates and transmits said first signal of a first waveform and said second signal of a different waveform from said first waveform.

17. The remote radio control system of claim 10 wherein said second receiver circuit includes a plurality of second receiver circuits, and means for tuning each of said plurality of second receiver circuits to different frequencies for actuating a multiplicity of special effects devices only after said first receiver circuit activates said plurality of second receiver circuits.

18. A remote control system for actuating theatrical special effects devices comprising:

(a) at least one theatrical special effects device selected from the group comprising a confetti-filled device, a lighting device, and a pyrotechnic device;

(b) a transmitter, said transmitter including means for generating and transmitting first and second signals;

(c) means mounting said theatrical special effects device at a location remote from said transmitter;

(d) first and second receiver circuit means mounted adjacent said theatrical special effects device at said remote location;

(e) said first and second receiver circuit means being receptive to only said first and second signals, respectively;

(f) said first receiver circuit means being connected to said second receiver circuit means for activating said second circuit means only upon receipt of said first signal; and (g) said second receiver circuit means including means for activating said theatrical special effects device only when said second circuit means has been activated by said first receiver circuit means and said second receiver circuit means receives said second signal.

19. The remote control system for actuating theatrical special effects devices of claim 18 including battery means mounted adjacent said first and second receiver circuits for powering said first and second receiver circuits.

20. The remote control system of claim 19 wherein said second receiver circuit means include a plurality of different receiver circuits, and means for tuning each of said different second receiver circuits to different second signals, and means for connecting said different second receiver circuits to different theatrical special effects devices.

* * * * *